US005619928A

United States Patent [19]

Theurer et al.

[11] Patent Number: 5,619,928

[45] Date of Patent: Apr. 15, 1997

[54] APPARATUS FOR TRANSPORTING AN ASSEMBLED TRACK SECTION

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 435,545

[22] Filed: May 5, 1995

[30] Foreign Application Priority Data

May 10, 1994 [AT] Austria ..... 978/94

[51] Int. Cl.[6] ..... E01B 29/02

[52] U.S. Cl. ..... 104/3

[58] Field of Search ..... 104/2, 3, 5, 7.1; 105/4.1, 4.2, 4.3

[56] References Cited

U.S. PATENT DOCUMENTS

| | | | |
|---|---|---|---|
| 4,249,467 | 2/1981 | Theurer | 104/3 |
| 4,566,389 | 1/1986 | Theurer | 104/3 |
| 4,773,332 | 9/1988 | Theurer et al. . | |
| 4,784,063 | 11/1988 | Theurer et al. . | |
| 5,127,335 | 7/1992 | Whitaker | 104/3 |

FOREIGN PATENT DOCUMENTS 3419205 10/1986 Germany .

*Primary Examiner*—Robert J. Oberleitner
*Assistant Examiner*—C. T. Bartz
*Attorney, Agent, or Firm*—Collard & Roe, P.C.

[57] ABSTRACT

A mobile apparatus for loading and transporting an assembled track section and for laying the track section on a track bed comprises a track section hoisting device comprising an elongated carrier frame extending in the longitudinal direction of the track bed, pairs of lifting jacks spaced from each other in said direction, and drives for vertically adjusting the lifting jacks between a retracted position and an extended position in which the lifting jacks support the carrier frame on the track bed. An elongated transport car for supporting an assembled track section and the hoisting device is movable in this direction independently of the hoisting device. The elongated carrier frame and transport car each are comprised of two parts connected by a pivot between their opposite ends for pivoting the parts relative to each other about a vertical axis. Track-bound undercarriages and vertically adjustable off-track undercarriages are arranged adjacent each end and the pivot of the transport car, and one of the pairs of lifting jacks is arranged adjacent the pivot of the carrier frame.

10 Claims, 1 Drawing Sheet

APPARATUS FOR TRANSPORTING AN ASSEMBLED TRACK SECTION

BACKGROUND OF THE INVENTION

1. Field of the Invention

The present invention relates to a mobile apparatus for loading and transporting an assembled track section consisting of rails fastened to ties and for laying the track section on a track bed, which comprises a track section hoisting device comprising an elongated carrier frame extending in the longitudinal direction of the track bed, pairs of lifting jacks spaced from each other in this direction, and drive means for vertically adjusting the lifting jacks between a retracted position and an extended position in which the lifting jacks support the carrier frame on the track bed. The apparatus also comprises an elongated self-propelled transport car for supporting an assembled track section and the hoisting device, the transport car being movable in this direction independently of the hoisting device and having two opposite ends spaced from each other in said direction, and track-bound undercarriages and vertically adjustable off-track undercarriages adjacent each end of the transport car.

2. Description of the Prior Art

Such a mobile apparatus is known from U.S. Pat. No. 4,784,063 and comprises a transport car and a hoisting device which is independent of the transport car and may be driven to and from an operating site with an assembled track section loaded on the car. When an assembled track section consisting of rails fastened to ties, such as a track switch, is to be removed and replaced, the transport car is moved in the longitudinal direction of the track bed to dispose the hoisting device comprising an elongated carrier frame extending in this direction above the assembled track section, whereupon the carrier frame is supported on the track bed by lowering the lifting jacks into engagement with the track bed while the lifting jacks lift the carrier frame off the transport car. The transport car is then moved off the operating site, the carrier frame is lowered by the lifting jacks toward the track section to be removed, the track section is gripped with vertically adjustable clamping devices on the carrier frame, and the lifting jacks are again operated to raise the carrier frame carrying the track section. The off-track undercarriages on the transport car are then lowered and the transport car is moved back to the operating site on the off-track undercarriages underneath the raised carrier frame and track section. The track section may then be lowered onto the transport car to be transported away from the operating site. This sequence of operations is reversed to place a new track section on the track bed after an old track section has been removed. If the track section is very long, two such mobile installations arranged one behind the other are used.

A similar apparatus has been disclosed in U.S. Pat. No. 4,773,332. In this installation, the hoisting device has two track-bound undercarriages and a pair of lifting jacks at each undercarriage so that the hoisting device may be moved along the track as well as the track section to be removed or to be inserted in the track. The hoisting device and the assembled track section may be loaded on the transport car.

German patent No. 3,419,205 discloses a track maintenance machine for laying and removing a track section, which is comprised essentially of an elongated carrier frame consisting of two parts connected to each other by a cardan joint. Retractable track-bound and off-track undercarriages are arranged at each end of the carrier frame and at the cardan joint to support the carrier frame selectively on the track or the ballast bed of an operating site from which a track section has been removed. Vertically adjustable gripping devices on the carrier frame clamp the track section to the carrier frame.

SUMMARY OF THE INVENTION

It is the primary object of this invention to provide an apparatus of the first-indicated type, which is particularly useful for loading, transporting and laying very long assembled track sections, such as switches.

The above and other objects are accomplished according to the invention with a mobile apparatus for loading and transporting an assembled track section consisting of rails fastened to ties and for laying the track section on a track bed, which comprises a track section hoisting device comprising an elongated carrier frame extending in the longitudinal direction of the track bed, pairs of lifting jacks spaced from each other in said direction, and drive means for vertically adjusting the lifting jacks between a retracted position and an extended position in which the lifting jacks support the carrier frame on the track bed. It further comprises an elongated transport car for supporting an assembled track section and the hoisting device, the transport car being movable in this direction independently of the hoisting device and having two opposite ends spaced from each other in this direction, the elongated carrier frame and transport car each being comprised of two parts connected by a pivot between the opposite ends for pivoting the parts relative to each other about a vertical axis, track-bound undercarriages and vertically adjustable off-track undercarriages adjacent each end and the pivot of the transport car, and one of the pairs of lifting jacks being arranged adjacent the pivot of the carrier frame.

An apparatus with a two-part carrier frame and transport car, whose parts are pivotally interconnected, for the first time makes it possible to transport a very long assembled track section, which has been pre-assembled in a factory to assure high quality and precision, to an operating site by moving the transport car with the carrier frame on a track, remove the old track section for transport away from the operating site to leave a trackless gap, and then lower the assembled track section on the trackless gap without making it necessary to assemble and weld together shorter track sections at the operating site, which would reduce the quality and accuracy of the newly laid track section. In addition, it has been found to be advantageous to use a unitary apparatus—rather than two independent installations—because of the simpler operation as well as the gentler wear and tear of the rail fastening elements. The arrangement of track-bound and off-track bogies at the pivots enables them to be centered above the center line of the track on the track as well as in the trackless gap. On the other hand, it also makes it possible selectively to change the transverse distance of the pivots from the center line. In this way, the two carrier frame parts may be optimally adjusted to the gravity point line of a switch to be lifted or lowered while the two transport car parts may be optically positioned with respect to the transport path.

An optimal movement of the apparatus in track curves is assured if the track-bound undercarriage adjacent the pivot of the transport car is spaced a substantially equal distance from the track-bound undercarriages adjacent the car ends.

According to other preferred features of the present invention, which enable one part of the apparatus to be uncoupled if the entire length of the apparatus is not needed, the track-bound undercarriage adjacent the pivot of the transport car is arranged immediately adjacent thereto and between the pivot and the vertically adjustable off-track undercarriage. The pivots are universal joints detachably coupling the parts together.

To enable particularly heavy track switches to be handled by the apparatus, one of the transport car parts is a trailer, and the trailer part carries an auxiliary track-bound undercarriage adjacent the pivot. Preferably, the auxiliary track-bound undercarriage is a single-axle bogie and comprises a drive for vertically adjusting the bogie. The drive may comprise a rotatable spindle.

To enable the hoisting device to be moved on the newly laid track section for positioning, each part of the carrier frame carries at least one vertically adjustable auxiliary undercarriage and a drive for vertically adjusting the auxiliary undercarriage for supporting the carrier frame on an assembled track section, and each auxiliary undercarriage preferably comprises a pivotal frame having one end connected to the drive for vertically adjusting the frame and a pair of flanged wheels mounted on an end of the pivotal frame opposite to the one end. The pivotal frame is mounted on the carrier frame for pivoting about a horizontal axis.

BRIEF DESCRIPTION OF THE DRAWING

The above and other objects, advantages and features of this invention will become apparent from the following detailed description of certain now preferred embodiments thereof, taken in conjunction with the accompanying schematic drawing wherein.

DETAILED DESCRIPTION OF THE PREFERRED EMBODIMENTS

Figure 1:
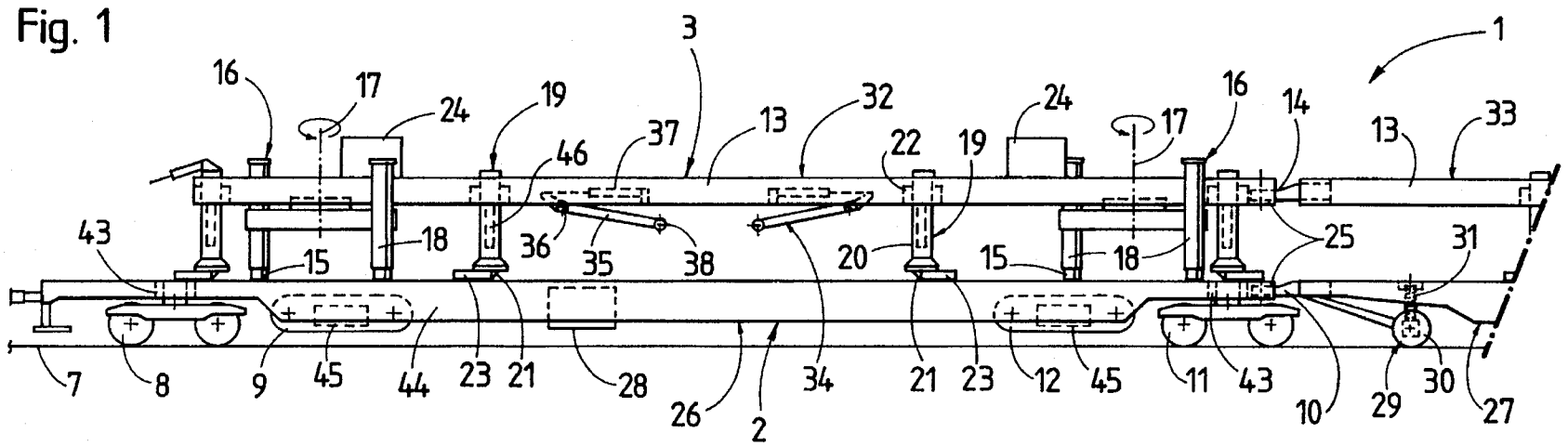
FIG. 1 is a partial side elevation of an apparatus according to the invention for loading and transporting an assembled track section consisting of rails fastened to ties and for laying the track section on a track bed, showing the apparatus during the movement along the track to an operating site, with the carrier frame supported on the transport car.
Figure 2:
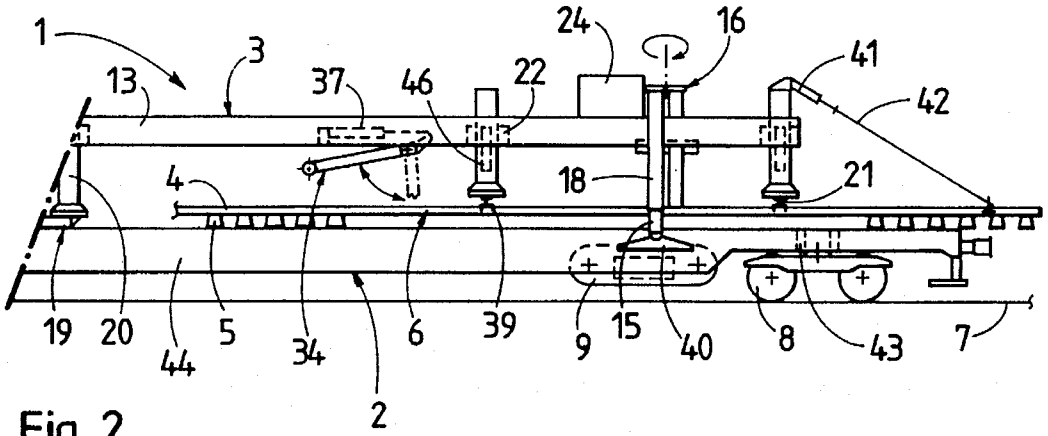
FIG. 2 shows the adjoining portion of the apparatus of FIG. 1 in side elevation, the apparatus being too long to be illustrated in a single figure.

In the drawing, like reference numerals refer to like parts functioning in a like manner in all figures. Referring first to FIGS. 1 and 2, there is shown mobile apparatus 1 for loading and transporting assembled track section 6 consisting of rails 4 fastened to ties 5 and for laying track section 6 on a track bed. Apparatus 1 comprises track section hoisting device 3 comprising elongated carrier frame 13 extending in the longitudinal direction of the track bed. The carrier frame is a carrier beam comprised of two parts 32, 33, and pairs 16 of lifting jacks 15 are spaced from each other in this direction to support the carrier frame at opposite ends thereof and adjacent pivot 14 connecting the parts 32 and 33 of carrier frame 13. Drives 18 enable lifting jacks 15 to be vertically adjusted between a retracted position (shown in the drawing) and an extended position in which the lifting jacks support carrier frame 13 on the track bed. Each pair 16 of lifting jacks 15 is rotatably mounted on carrier frame 13 for rotating about vertical axis 17 so that the lifting jacks may be positioned alongside the carrier frame, and each lifting jack may be independently adjusted in a horizontal direction to be spaced from vertical axis 17 a desired distance to enable the lifting jacks to engage the track bed laterally adjacent transport car 2 upon vertical adjustment by drives 18.

Elongated self-propelled transport car 2 is a flatbed car comprised of two parts 26, 27 for supporting assembled track section 6 and hoisting device 3. Transport car 2 is movable in the longitudinal direction independently of hoisting device 3 and has two opposite ends spaced from each other in this direction. The two parts 32, 33 of elongated carrier frame 13 and the two parts 26, 27 of transport car 2 are connected by pivot 10, 14, respectively, substantially centered between the opposite ends for pivoting the parts relative to each other about the same vertical axis. Pivots 10 and 14 are preferably detachable universal couplings 25. Track-bound undercarriages 8 and vertically and transversely adjustable off-track undercarriages 9 adjacent each end of the transport car selectively support the transport car on track 7 or on the track bed in a trackless gap, and track-bound undercarriage 11 and vertically and transversely adjustable off-track undercarriage 12 selectively support the transport car at pivot 10 of the transport car. Track-bound undercarriage 11 adjacent pivot 10 of transport car 2 is spaced a substantially equal distance from track-bound undercarriages 8, 8 adjacent the car ends. Track-bound undercarriage 11 adjacent pivot 10 of transport car 2 is arranged immediately adjacent thereto and between pivot 10 and off-track undercarriage 12. Pivots 10 and 14 are universal joints detachably coupling the parts together. All the off-track undercarriages have their own drives 45.

As shown, transport car part 27 is a trailer coupled to transport car part 26, and this trailer part carries auxiliary track-bound undercarriage 29 adjacent pivot 10. The auxiliary track-bound undercarriage is a single-axle bogie 30 and comprises drive 31 for vertically adjusting the bogie. In the illustrated embodiment, drive 31 comprises a rotatable spindle.

Carrier frame part 32 equipped with two pairs 16 of lifting jacks 15 is associated with part 26 of transport car 2, and each part 32, 33 of carrier frame 13 carries at least one vertically adjustable auxiliary undercarriage 34 and drive 37 is arranged for vertically adjusting the auxiliary undercarriage for supporting carrier frame 13 on an assembled track section 6 and for moving the carrier frame along such a track section after it has been laid. As shown, each auxiliary undercarriage 34 comprises pivotal frame 35 having one end connected to drive 37 for vertically adjusting the frame by pivoting it about transverse horizonal axis 36 and a pair of flanged wheels 38 mounted on an end of the pivotal frame opposite to the one end. The flanged wheels may be lowered into engagement with rails 4 of the assembled track section placed on the track bed and may be driven to move the carrier frame along the track.

Hoisting device 3 is equipped with carrier devices 19 which are mounted on carrier frame 13 and are spaced from each pair 16 of lifting jacks 15 in the longitudinal direction on each side of the pair of lifting jacks so that each pair of lifting jacks is arranged between two carrier devices. Each carrier device 19 is comprised of vertical carrier 20 and horizontal beam 21. Vertical carrier 20 is vertically adjustably mounted in guide bearing 22 and may be vertically adjusted by drive 46. Outer ends 23 of beam 21 are pivotal in a horizontal plane and may be pivoted between a transversely outwardly extending position and a retracted position extending in the longitudinal direction. Motors 24 are mounted on carrier frame 13 to power drives 18 and 46 for each pair 16 of lifting jacks 15 and associated carrier devices 19.

The apparatus is operated in the following manner:

As shown in FIGS. 1 and 2, when apparatus 1 is driven along track 7 to an operating site, off-track undercarriages 9 and 12 are in their retracted position so that track-bound undercarriages 8 and 11 run on the track. When no assembled track section 6 is transported to the operating site, beams 21 of carrier devices 19 support hoisting device 3 on transport car 2 while ends 23 of the beams are pivoted inwardly to extend in the longitudinal direction rather than projecting laterally outwardly. Pairs 16 of lifting jacks 15 are rotated about axis 17 so that the lifting jacks are also positioned within the loading gauge of transport car 2, as shown in FIG. 1.

When, as shown in FIG. 2, an assembled track section 6 is transported, rail gripping clamps 39 on carrier device beams 21, which rest on rails 4 of the track section, connect the track section to hoisting device 3. The track section and the hoisting device are supported on transport car 2 and pairs 16 of lifting jacks 15 are rotated so about vertical axis 17 and the transverse spacing of the lifting jacks of each pair is so adjusted that support shoes 40 of the lifting jacks are positioned laterally adjacent the sides of the transport car. If track section 6 is very long, an end of the track section projecting rearwardly from the transport car is held up by a rope or cable 42 attached to tensioning device 41. In addition, auxiliary bogie 29 (FIG. 1) may be lowered to engage track 7 so that the very heavy weight of a track section with concrete ties, for example, may be distributed over an additional axle.

To improve the movement of the very long apparatus 1 carrying an assembled track section 6 along a track curve, track-bound undercarriages 8 and 11 are mounted on car frame 44 of transport car 2 for transverse movement by drives (not shown) along guide bearings 43. This enables particularly the ends of the transport car to be transversely adjusted relative to the center line of track 7 to minimize the displacement of track section 6 relative to car frame 44 due to the bend of apparatus 1 at pivot 10.

At the operating site, the apparatus is operated substantially in the manner described in the above-named U.S. patents.

Figure 3:
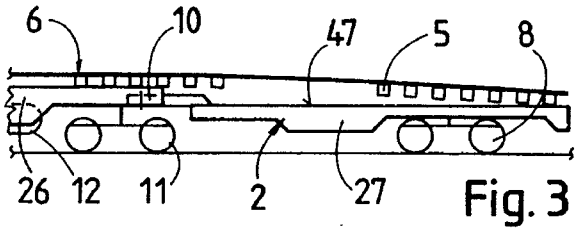
FIGS. 3 and 4 are smaller fragmentary views of other embodiments of the pivotal connections of the two parts of the transport car.
Figure 4:
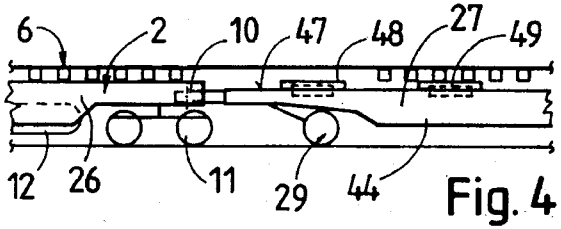

Further improvements for moving apparatus 1 in track curves are schematically illustrated in FIGS. 3 and 4, in which hoisting device 3 has not been shown because the illustrated modifications deal only with transport car 2.

In the embodiment of FIG. 3, loading platform 47 of trailing transport car part 27 extends in a plane just below the loading platform of leading transport car part 26. The wider and, therefore, heavier portion of track switch 6 is supported on the leading transport car part. This positioning of the track switch on transport car 2 has the effect that there is no contact between ties 5 of switch 6 and loading platform 47 of trailing transport car part 27 immediately adjacent pivot 10. Therefore, the friction forces occurring in track curves between switch 6 and the laterally moving parts of transport car 2 are substantially smaller in transport car part 27 than in transport car part 26.

An even more effective reduction of these friction forces can be obtained with the embodiment shown in FIG. 4. In this embodiment, loading platform 47 of trailing transport car part 27 is equipped with gliding plates 48. The glide plates are mounted on transport car frame 44 by rollers 49 whose axes of rotation are oriented to the fulcrum of pivot 10. The heavy portion of switch 6 is again supported on transport car part 26 and the other end thereof rests on glide plates 48, which may be displaced in a transverse direction. In this way, any friction in track curves between the track switch and transport car 2 can be practically eliminated.

What is claimed is:

1. A mobile apparatus for loading and transporting an assembled track section consisting of rails fastened to ties and for laying the track section on a track bed, which comprises (a) a track section hoisting device comprising
  (1) an elongated carrier frame extending in the longitudinal direction of the track bed,
  (2) pairs of lifting jacks spaced from each other in said direction, and
  (3) drive means for vertically adjusting the lifting jacks between a retracted position and an extended position in which the lifting jacks support the carrier frame on the track bed, (b) an elongated transport car for supporting an assembled track section and the hoisting device, the transport car being movable in said direction independently of the hoisting device and having two opposite ends spaced from each other in said direction, (c) the elongated carrier frame and transport car each being comprised of two parts connected by a pivot between the opposite ends for pivoting the parts relative to each other about a vertical axis, (d) track-bound undercarriages and vertically adjustable off-track undercarriages adjacent each end and the pivot of the transport car, and (e) one of the pairs of lifting jacks being arranged adjacent the pivot of the carrier frame.

2. The mobile apparatus of claim 1, wherein the track-bound undercarriage adjacent the pivot of the transport car is spaced a substantially equal distance from the track-bound undercarriages adjacent the car ends.

3. The mobile apparatus of claim 1, wherein the track-bound undercarriage adjacent the pivot of the transport car is arranged immediately adjacent thereto and between the pivot and the vertically adjustable off-track undercarriage.

4. The mobile apparatus of claim 1, wherein the pivots are universal joints detachably coupling the parts together.

5. The mobile apparatus of claim 4, wherein one of the transport car parts is a trailer, and the trailer part carries an auxiliary track-bound undercarriage adjacent the pivot.

6. The mobile apparatus of claim 5, wherein the auxiliary track-bound undercarriage is a single-axle bogie and comprises a drive for vertically adjusting the bogie.

7. The mobile apparatus of claim 6, wherein the drive comprises a rotatable spindle.

8. The mobile apparatus of claim 1, wherein each part of the carrier frame carries at least one vertically adjustable auxiliary undercarriage and a drive for vertically adjusting the auxiliary undercarriage for supporting the carrier frame on an assembled track section.

9. A mobile apparatus for loading and transporting an assembled track section consisting of rails fastened to ties and for laying the track section on a track bed, which comprises (a) a track section hoisting device comprising
  (1) an elongated carrier frame extending in the longitudinal direction of the track bed,
  (2) pairs of lifting jacks spaced from each other in said direction, and
  (3) drive means for vertically adjusting the lifting jacks between a retracted position and an extended position in which the lifting jacks support the carrier frame on the track bed, (b) an elongated transport car for supporting an assembled track section and the hoisting device, the transport car being movable in said direction independently of the hoisting device and having two opposite ends spaced from each other in said direction, (c) the elongated carrier frame and transport car each being comprised of two parts connected by a pivot between the opposite ends for pivoting the parts relative to each other about a vertical axis, (1) each part of the carrier frame carries at least one vertically adjustable auxiliary undercarriage and a drive for vertically adjusting the auxiliary undercarriage for supporting the carrier frame on an assembled track section, and (2) each auxiliary undercarriage comprises a pivotal frame having one end connected to the drive for vertically adjusting the frame and a pair of flanged wheels mounted on an end of the pivotal frame opposite to the one end, (d) track-bound undercarriages and vertically adjustable off-track undercarriages adjacent each end and the pivot of the transport car, and (e) one of the pairs of lifting jacks being arranged adjacent the pivot of the carrier frame.

10. The mobile apparatus of claim 9, wherein the pivotal frame is mounted on the carrier frame for pivoting about a horizontal axis.

* * * * *